United States Patent [19]

Goodman

[11] Patent Number: 4,530,190

[45] Date of Patent: Jul. 23, 1985

[54] SELF-ANCHORING FENCE POST AND METHOD OF INSTALLING SAME

[76] Inventor: Jack P. Goodman, 4000 Holland Dr., Wheat Ridge, Colo. 80033

[21] Appl. No.: 563,805

[22] Filed: Dec. 21, 1983

[51] Int. Cl.[3] ..... E21B 11/02; E02D 5/80

[52] U.S. Cl. ..... 52/165; 52/155; 52/742; 52/749; 175/23; 405/243; 248/545

[58] Field of Search ..... 52/155, 158, 165, 742, 52/749; 175/23; 405/239-243; 248/545

[56] References Cited

U.S. PATENT DOCUMENTS

| | | | |
|---|---|---|---|
| 806,838 | 12/1905 | Raymond | 405/243 |
| 869,336 | 10/1907 | Stewart | 175/23 |
| 1,879,414 | 9/1932 | Munoz | 52/165 X |
| 2,554,896 | 5/1951 | Caudill | 405/243 |
| 3,894,589 | 7/1975 | Ciraud | 52/165 X |
| 3,916,564 | 11/1975 | Crowell, Sr. | 175/23 X |
| 3,969,853 | 7/1976 | Deike | 52/165 X |
| 4,252,472 | 2/1981 | Moraly | 52/165 X |
| 4,279,104 | 7/1981 | Classen | 52/165 X |
| 4,395,012 | 7/1983 | Rance | 248/545 |

*Primary Examiner*—J. Karl Bell
*Assistant Examiner*—Richard E. Chilcot, Jr.
*Attorney, Agent, or Firm*—Edwin L. Spangler, Jr.

[57] ABSTRACT

This invention relates to an improved self-anchoring fence post characterized by an anchor member in the form of a rigid blade substantially bisected by a vertically-disposed groove for use in initially detachably clamping same to a driving tool for both burying it in the ground and simultaneously producing a posthole therebeneath. Following removal of the driving tool, this same groove is employed to permanently clamp the anchor member to a fence post passed down alongside thereof into the posthole. The invention also includes an apertured disc which is placed on the end of the driving tool and precedes same down into the ground so as to produce an oversize hole from which the tool can be removed as well as a permanent base upon which to rest the fence post. The invention further encompasses the method of installing the post by using the disc to drive an oversize posthole while simultaneously burying the anchor member.

8 Claims, 5 Drawing Figures

SELF-ANCHORING FENCE POST AND METHOD OF INSTALLING SAME

By far the most common and age-old method of installing a fence post, is to dig an oversize hole, rest the post in the bottom of the hole and backfill around the latter, preferably with concrete. This is a time consuming and laborious operation, especially when it must be repeated over and over again every few feet.

Applicant is aware of prior art which has attempted to solve this problem by driving a specially-shaped anchor member into the ground, inserting a post into the buried anchor member, and then using a wedge to complete the connection between the two. This is the so-called "V-Loc" system that forms the subject matter of U.S. Pat. Nos. 4,021,977 and 4,320,608.

For purposes of the present invention, the earlier of the two patents mentioned above appears to be the most pertinent since it, like applicant's invention, both envision driving a fin-carrying or fluked anchor member into the ground and using the latter as the means for supporting a fence post, sign post or the like subsequently added. Both units require some sort of impact tool, preferably powered, to drive and bury the anchor. The patented anchor, on the other hand, requires that some sort of downwardly-extending leg which is an integral part thereof and remains buried in the ground, precede the fluked portion. Applicant's unit, by way of contrast, uses the shaft of a specially-designed impact tool along with an expandable disc on the lower end of the latter to drive a slightly oversize hole from which the shaft can be easily extricated preparatory to being replaced by the post itself. The plate left in the bottom of the hole thus formed provides a base for the post sitting atop a highly compacted subsurface.

The other main difference lies in the manner in which the post is fastened to the anchor member. The patented unit uses wedges and special tools for this purpose, whereas, applicant employs a simple clamp and two bolts for both holding the anchor member on the impact tool shaft while it is being driven and also to fasten the post to the anchor member later on.

Applicant's method of driving the hole using the apertured disc results in a highly compacted hole wall and bottom that cannot be realized by driving an open ended tube into the ground. It is worthy of note that even in the method set forth in Deike's U.S. Pat. No. 4,021,977, the solid blunt-ended rod is only used in the bottom of the hole leaving the upper portion thereof all the way to the surface lightly compacted.

It is, therefore, the principal object of the present invention to provide a novel and improved self-anchoring fence post.

A second objective is to provide a unique method for installing the latter.

An additional object of the invention herein disclosed and claimed is to provide a self-anchoring fence post and method of installing same that requires no backfilling.

Another object is the provision of a method of the type aforementioned which requires that a slightly oversize posthole be driven using a non-recoverable plate that ends up forming a base at the bottom of the hole for supporting the post.

Still another object of the within described invention is to provide a self-anchoring post which is particularly well suited for use as a fence post when the radially and diametrically-extending flukes or fins on the anchor member are aligned along the fence line.

Further objects are to provide a fence post that is simple and fast to install, rugged, versatile, stable and even decorative.

Other objects will be in part apparent and in part pointed out specifically hereinafter in connection with the description of the drawings that follows, and in which.

Figure 1:
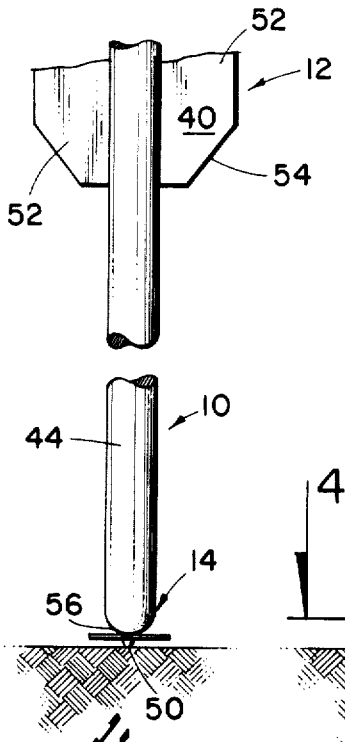
FIG. 1 is a fragmentary elevational view showing the anchor member and apertured plate in place upon the shaft of the specially-designed driving tool preparatory to driving the assembly into the ground.
Figure 4:
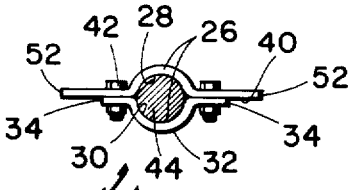
FIG. 4 is a section taken along line 4—4 of FIG. 1.
Figure 2:
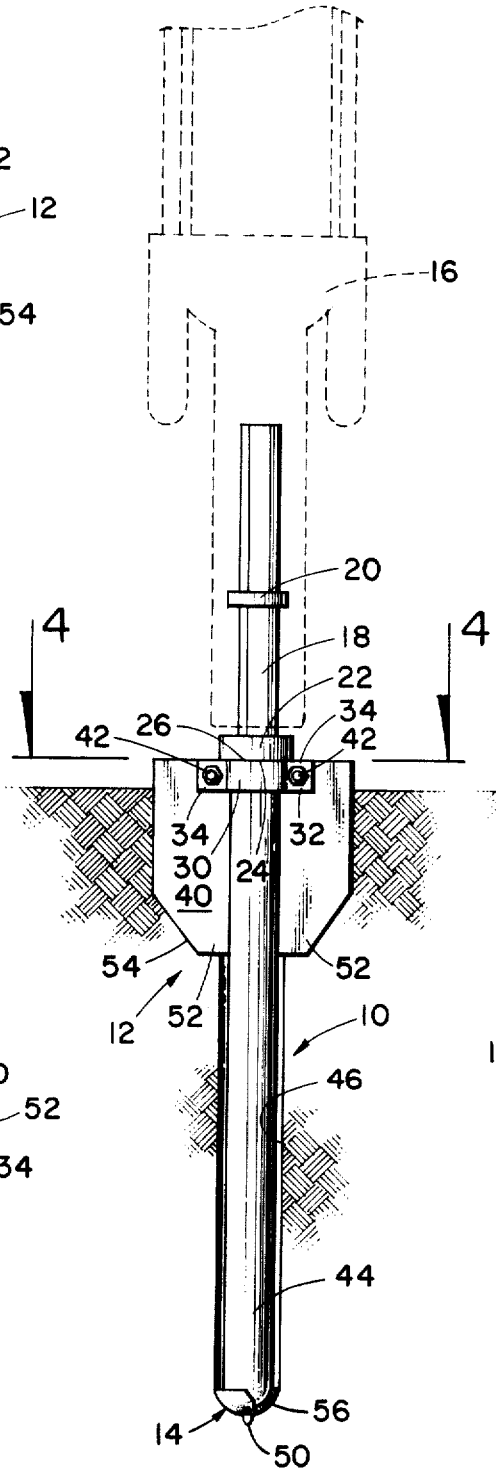
FIG. 2 is a view like FIG. 1 but showing the assembly after the posthole has been formed but before the shaft of the driving tool has been withdrawn, the apparatus for driving the assembly having been shown in phantom lines.

Referring next to the drawings for a detailed description of the present invention and, initially, to FIGS. 1, 2 and 4 for this purpose, reference numeral 10 has been chosen to broadly identify the specially designed driving tool while reference numerals 12 and 14 similarly designate the anchor member and cap plate, respectively, that are driven into the ground by the tool. Tool 10 can, of course, be driven manually using a sledge; however, the preferred method is to use a standard commercially available pneumatic hammer such as that indicated in phantom lines in FIG. 2 and which has been assigned reference numeral 16.

Driving tool 10 consists of a modified drill steel of the type having the hexagonal cross section 18 with an upper annular collar 20 therearound (FIG. 2) that is impacted by the driven element (not shown) of the air hammer. The modifications comprise a second collar 22 spaced beneath the existing one defining a downwardly-facing annular shoulder 24 adapted to rest atop the essentially coplanar ring 26 on the upper margin of the anchor member 10 defined by the vertically-disposed semi-cylindrical groove 28 in the latter and the supplementary and correspondingly-shaped offset 30 in clamp member 32. Integrally-formed coplanar ears 34 projecting in opposite directions from both sides of the offset 30 provide the means for detachably fastening the clamp to the grooved face 40 of the anchor member using bolts 42. When assembled as shown in FIGS. 2 and 4, the anchor member 12 is fastened to the stem 44 of the driving tool underneath collar 22.

In the particular form shown in FIGS. 1, 2 and 4, stem 44 is cylindrical so as to drive a round posthole 46 in the ground. Alternatively, should one wish to seat a square post, stem 44 would be shaped accordingly as seen at 44M in FIG. 5. Thus, the second modification of a standard drill steel is to shape the stem 44 below the added collar 22 so as to produce a posthole 46 matching the cross section of the post 48 (FIG. 3) that will eventually be inserted therein.

The third and final modification is to provide the lower end of the driving tool with a retaining device 50

(FIGS. 1 and 2) for keeping cap plate 14 in proper position on the end thereof while the latter is being driven into the ground. In the particular form shown, this retaining element comprises a simple pin projecting downward axially from the lower end of the stem.

FIGS. 1-4, inclusive, show the anchor member 12 to comprise a relatively heavy gauge plate, usually metal, stiff and rugged enough to be driven edgewise through hard ground. As illustrated, the width of the anchor member is approximately four times the diameter of the post 48 it will anchor although neither this dimension or its length is especially critical, the latter being about the same as the width. Obviously, the wider and longer the anchor member, the more difficult it will be to drive into the ground but, the better it can be expected to hold. Conversely, however, reducing the size of the anchor member significantly beyond the size shown, so reduces its holding power that it no longer adequately performs its intended function which is, or course, to resist tilting of the post, especially in a direction normal to the plane of its flukes 52.

In the preferred form, anchor member 12 has the lower corners thereof truncated as shown at 54 to produce a more or less "spade-like" shape better adapted to penetrate the ground than if square-cut. Flukes 52 are preferably planar, coplanar with each other and substantially co-axial with the axis of groove 28 so that they will each enter the ground at the same angle as the driving tool and provide essentially equal resistance to loads applied to either side of the post in a direction to move the anchor member broadside.

The groove 28 in the anchor member is preferably placed about midway between its side margins since no advantage is realized by offsetting it one way or another. The shape of the groove 28 and its counterpart 30 in the clamp 32 preferably cooperate to conform to the cross section of the post 48; however, even a cylindrical opening like that shown in FIG. 4 will clamp satisfactorily onto a square driving tool stem, a triangular one or various other shapes to the degree required for driving the anchor into the ground. The same is true for clamping onto the post itself although, obviously, the better they mate, the tighter the anchor member holds onto the post.

Figure 3:
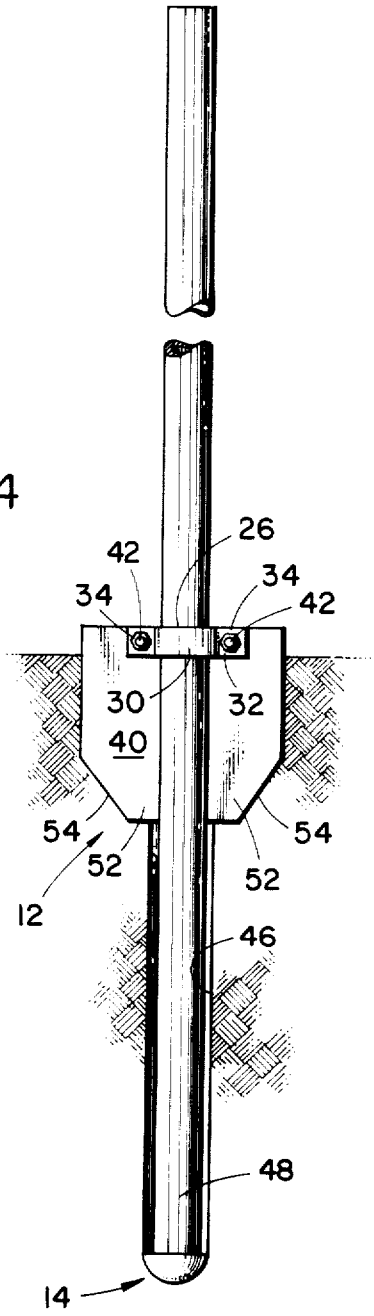
FIG. 3 is a view like FIGS. 1 and 2 but showing the assembly following removal of the impact tool shaft and substitution of the fence post therefor.

Cap plate 14 for anchoring a cylindrical post 48 as seen in FIG. 3 comprises a circular disc with a hole in the center to receive pin 50 on the stem of the driving tool. Its diameter, however, is substantially greater than that of either the stem 44 of the driving tool or the post 48 which are preferably of the same size. Cap plate 14 is one of the most important and innovative features of the present invention since it, upon being driven down into the ground as shown in FIG. 2, cups around the hemispherically-shaped tip 56 of the driving tool stem while, at the same time, making a slightly larger hole 46 by an amount equal to approximately twice its thickness. The slightly oversize posthole 46 thus produced has been greatly exaggerated in the drawing for purposes of illustration, it being only a quarter of an inch larger in diameter than the stem of the tool 10 or the post 48 in actual practice. By using the cap plate 14 to drive an oversize hole 46, the tool 10 can be retrieved therefrom quite easily once clamp 32 is loosened. Likewise, post 48 slips back down into the same hole left vacant by removal of the driving tool the same way.

When the driving tool is extracted, the shaped cap plate 14 is left at the bottom of the hole to provide a base upon which the post 48 rests as shown in FIG. 3. As the cap plate is forced down into the ground, it forces the ground aside and compacts it much more than if a drilled hole would do. This, of course, keeps the sides from caving in when the driving tool is removed and the post reinserted.

As revealed most clearly in FIG. 2, the anchor member is driven as deeply as possible into the ground while, at the same time, leaving the clamp-fastening bolts accessible so that they can be loosened to remove the driving tool and retightened around the post. Once the post is in place, of course, the entire anchor member can be covered up if desired.

Figure 5:
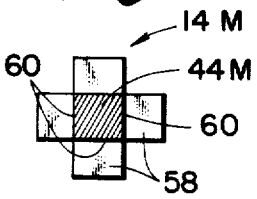
FIG. 5 is a transverse section to an enlarged scale showing a modified version of the driving tool and cap plate for use in making postholes to accommodate square posts.

Before discussing the method of installing the post, most of which has already been explained, brief reference should, perhaps, be made to FIG. 5 wherein a square-stemmed driving tool 44M has been shown fitted with a generally X-shaped cap plate 14M. Obviously, if one were to start out with cap plate 14M spread out as shown on the end of the driving tool, the first few blows would cause the foldable wings 58 to bend and assume a position alongside the vertically-disposed flat faces 60 of stem 44M. When this occurs, cap plate 14M will upon being driven into the ground, perform the same function as cap plate 14 of FIGS. 1-4, namely, that of producing a slightly oversize hole shaped to accommodate a post of substantially the same size and shape as the stem of the driving tool 10.

Finally, the method of placing the post 48 will have been seen to consist of first selecting a driving tool 10 having a stem portion 44 at the lower end thereof of essentially the same size and shape as the post 48 to be installed. Next, the anchor member 12 is temporarily clamped to the stem of the driving tool underneath collar 22 using bolts 42.

A cap plate 14 must then be chosen of a shape and size to cooperate with the driving tool 10 in making a slightly oversize hole adapted to release the stem of the latter once the hole is complete and provide for reinsertion of the post. Upon completion of these preparations, the cap plate is driven into the ground followed by the anchor member which is buried to a level just short of where the bolts 42 will be covered. Due consideration must be given, of course, to orientation of the anchor member flukes 30 in terms of the loads expected on the post particularly the direction of the latter. In other words, if the post 48 is to serve as an intermediate post in a long line of fencing, then the flukes should be lined up with the fence since the adjacent posts and fencing therebetween will be effective to resist loads tending to tilt the post in the plane of the fence. If, on the other hand, post 48 was at the end of a run and was not to be otherwise braced, flukes 30 should be at right angles to the fence line. A cornerpost not otherwise braced should have the flukes at 45° to the runs of fencing disposed at right angles to one another.

The operation is completed once the hole has been driven by loosening the anchor member from the driving tool stem and extracting the latter while leaving the cap plate in the ground as a base for the post. The post is then passed down along the groove in the anchor member, bottomed on the cap plate and finally clamped to the anchor member as shown in FIG. 3.

What is claimed is:

1. The subassembly for use with a driving tool having a shaft with a lower end and a downwardly-facing shoulder spaced thereabove to seat and anchor a post in the ground which comprises: a plate of a shape and size adapted upon being placed on the lower end of a driving tool and driven into the ground to produce a posthole sufficiently oversized with respect to said tool to permit ready removal thereof, the posthole produced by said plate also being of a shape and size to permit ready insertion of a post therein while at the same time essentially preventing sidewise movement thereof, and said plate when left at the bottom of said posthole defining a base adapted to support a post resting atop thereof; and, an anchor member detachably connectable to the driving tool for burying same in the ground while the posthole is being driven and for anchoring a post within said posthole, said member comprising a rigid blade of a width and length at least several times greater than the thickness of the post it is to anchor substantially bisected by a vertically-disposed groove sized to receive both the driving tool and post when detachably connected thereto so as to maintain the orientation therebetween.

2. The subassembly as set forth in claim 1 wherein: the plate is circular and of a diameter slightly greater than the diameter of the cylindrical post to be placed in the posthole formed thereby.

3. The subassembly as set forth in claim 1 wherein: the plate has a cruciform shape and a size adapted to form a posthole of a size and shape slightly larger than the post with a rectangular cross section to be placed in the posthole formed thereby.

4. The subassembly as set forth in claim 1 wherein: the anchor member is generally rectangular with diagonally truncated lower outside corners.

5. The subassembly as set forth in claim 1 wherein: the plate is centrally apertured to receive an axial pin projecting from the lower end of the driving tool.

6. The subassembly as set forth in claim 1 wherein: the anchor member includes an upper edge, the position of which bordering the groove defines an anvil capable of withstanding the blows delivered thereto by an impacting shoulder of the driving tool.

7. The method of forming a posthole and anchoring a post therein which comprises the steps of: temporarily fastening a fluke-carrying anchor member underneath a shoulder on the shaft of an elongate rigid driving tool and placing a plate beneath the tip end thereof; impacting the tool from above to simultaneously bury the anchor member and plate while using the latter to drive a posthole, unfastening the anchor member from the tool and extracting the tool from the posthole so as to leave both the anchor member and plate in the ground, replacing the tool with a post bottomed on the plate, and refastening the anchor member to the post.

8. The method as set forth in claim 7 which includes bending the plate to conform with the tip end of the tool as said plate is being driven into the ground so as to produce a posthole slightly oversize with respect to the tool shaft.

* * * * *